US008162173B2

(12) United States Patent
Pommereau

(10) Patent No.: US 8,162,173 B2
(45) Date of Patent: Apr. 24, 2012

(54) GOLF BALL DISPENSER

(76) Inventor: Claude Pommereau, Draveil (FR)

( * ) Notice: Subject to any disclaimer, the term of this patent is extended or adjusted under 35 U.S.C. 154(b) by 733 days.

(21) Appl. No.: 10/525,900

(22) PCT Filed: Sep. 5, 2003

(86) PCT No.: PCT/FR03/02655
§ 371 (c)(1),
(2), (4) Date: Feb. 25, 2005

(87) PCT Pub. No.: WO2004/022174
PCT Pub. Date: Mar. 18, 2004

(65) Prior Publication Data

US 2006/0163273 A1 Jul. 27, 2006

(30) Foreign Application Priority Data

Sep. 6, 2002 (FR) ..... 02 11090

(51) Int. Cl.
*B03D 1/00* (2006.01)
*B03B 5/60* (2006.01)
*B03B 5/64* (2006.01)

(52) U.S. Cl. ..... 221/174; 221/304; 221/105; 221/86; 221/188; 221/189

(58) Field of Classification Search ..... 221/174, 221/304, 105, 86, 188, 189
See application file for complete search history.

(56) References Cited

U.S. PATENT DOCUMENTS

| | | | | | |
|---|---|---|---|---|---|
| 736,163 | A | * | 8/1903 | Stimpson | 221/182 |
| 1,102,297 | A | * | 7/1914 | Reid | 221/68 |
| 1,674,987 | A | * | 6/1928 | Pengilly | 221/142 |
| 1,729,918 | A | * | 10/1929 | Weidlich | 221/189 |
| 1,808,658 | A | * | 6/1931 | Hosier | 221/189 |
| 1,958,956 | A | * | 5/1934 | Preston | 221/282 |
| 2,269,066 | A | * | 1/1942 | Steininger | 221/188 |
| 2,394,621 | A | * | 2/1946 | Lightfoot | 221/188 |
| 2,426,149 | A | * | 8/1947 | Kenkel | 221/23 |
| 2,437,616 | A | * | 3/1948 | Satloff | 221/188 |
| 2,515,997 | A | * | 7/1950 | Haeff | 315/5.38 |
| 2,711,241 | A | * | 6/1955 | Abrahamsen | 193/38 |
| 2,955,823 | A | * | 10/1960 | Chanko | 124/7 |
| 3,008,607 | A | * | 11/1961 | Troll | 221/167 |
| 3,016,164 | A | * | 1/1962 | Matteson | 221/9 |
| 3,738,662 | A | * | 6/1973 | Hodgin | 473/133 |
| 4,141,558 | A | | 2/1979 | Hoffman | |
| 4,227,626 | A | * | 10/1980 | Merila | 221/188 |
| 4,253,668 | A | * | 3/1981 | Ose | 473/132 |
| 4,266,490 | A | * | 5/1981 | Haines et al. | 111/104 |

(Continued)

FOREIGN PATENT DOCUMENTS

EP 0 272 001 6/1988

*Primary Examiner* — Stefanos Karmis
*Assistant Examiner* — Michael E Butler
(74) *Attorney, Agent, or Firm* — Greer, Burns & Crain, Ltd.

(57) ABSTRACT

The invention relates to a golf ball dispenser having an upper container which houses the golf balls and a flange which receives the balls from the container and which supplies the balls individually to a dispensing arm. The dispensing arm, which is disposed such that it is essentially vertical in the rest position, includes structure for pivoting around a horizontal axis when a golf ball is being dispensed, the pivot structure is disposed in the upper part thereof close to the above-mentioned flange.

7 Claims, 8 Drawing Sheets

U.S. PATENT DOCUMENTS 4,298,142 A * 11/1981 Stanley ..... 221/304
4,360,204 A * 11/1982 Karr ..... 473/137
4,391,446 A * 7/1983 Eberle ..... 473/137
4,575,092 A * 3/1986 Watson ..... 473/137
4,676,297 A * 6/1987 Kriegner et al. ..... 164/442
4,676,397 A * 6/1987 Hoffmeister ..... 221/105
4,892,318 A * 1/1990 Jennings ..... 473/137
5,060,996 A * 10/1991 Garnes ..... 294/19.2
5,346,222 A * 9/1994 Luther, Sr. ..... 473/137
5,361,937 A * 11/1994 Wiese ..... 221/189
5,472,189 A * 12/1995 Pfeiffer et al. ..... 221/155
5,549,518 A * 8/1996 Wang ..... 473/137
5,996,839 A 12/1999 McLinn
6,199,740 B1 * 3/2001 Benes et al. ..... 227/112
6,253,956 B1 * 7/2001 Khan et al. ..... 221/211
6,440,003 B1 * 8/2002 Phillips et al. ..... 473/137
6,481,373 B2 * 11/2002 Swetzig ..... 119/51.11
6,543,639 B1 * 4/2003 Kovens ..... 221/24
6,578,694 B2 * 6/2003 Harris et al. ..... 193/16
6,648,187 B1 * 11/2003 Shypkowski ..... 222/527
6,887,169 B2 * 5/2005 Whitehill et al. ..... 473/386
7,007,500 B2 * 3/2006 Lee ..... 62/389

* cited by examiner

GOLF BALL DISPENSER

This invention relates to a golf ball dispenser. It can be applied particularly favourably on a golf practice range, on which a golfer practices hitting the golf balls supplied to him in succession.

The role of a golf ball dispenser is essentially to place a golf ball on the tee on each action so that the golfer does not have to bend down to pick up and position the golf ball by hand.

Automatic systems are known that allow for the automatic dispensing of the golf ball onto the tee. However, these systems are complex, immobile and costly. These systems can be electric installations or mechanical installations such as the one described in document FR 2 625 442. This document relates to a dispenser in the form of a semi-buried chute. The lower end of the chute comprises a rod and spring system to supply a tee with one ball each time. The tee is arranged underground when it is supplied by the chute. An actuating pedal is used to raise the tee to the surface. The chute is fixed.

Portable devices are also known for which the golfer manipulates if applicable a lever on the dispenser to slide a ball onto the tee.

Document EP 0 272 001 relates to a hollow arm in a vertical position. The balls are stored in the arm. The lower end is fitted with a holding system mounted on a pivot and comprising two protrusions, a first protrusion partly positioned in the arm to hold back the first lower ball, and a second protrusion that can be positioned partly inside the arm when the first protrusion pivots outwards. When the second protrusion is positioned in the arm, it prevents the second lower ball from dropping when the first ball is released by the first protrusion.

Document DE 196 27 187 describes a dispenser arm pivoting horizontally around a vertical shaft. The lower end of the arm comprises a bend to position the ball. This bent part is cut out so that it does not touch the ball when placed on the tee. An elastic return system is used to bring the arm back to a rest position for which a golf ball is prepared for dispensing.

The object of this invention is a new golf ball dispenser that is both strong and simple. Another object of this invention is to use gravity as much as possible in order to reduce the amount of handling required by the golfer.

At least one of the aforementioned aims is achieved with a golf ball dispenser comprising an upper container to contain the golf balls and a flange to receive the balls coming from the container and supply a dispenser arm with balls one by one. According to the invention, the dispenser arm is arranged approximately vertically in a rest position and comprises means, arranged in the upper part close to the flange, of pivoting around a horizontal axis when a golf ball is dispensed.

With the device according to the invention, the pivoting is a swinging movement. The dispenser arm returns to its rest position by gravity. The golfer simply has to release the dispenser arm for it to return to its rest position. In most of the existing systems, the return is generally forced by means of a spring. However, the spring is a component that can rust or fail, and requires maintenance and proportioning of the return force.

The force of gravity is therefore used to drop the golf balls one by one onto the tee or onto the practice mat, or directly onto the ground. The player can use a golf club to pull the lower part of the dispenser arm to bring it into a dispensing position above the chosen location.

More specifically, the flange may comprise a tubular receptacle through which the golf balls from the container pass to reach the dispenser arm. The receptacle may comprise an upper part with a diameter designed to guide the golf balls from the container one by one, and a lower part with a larger diameter than the upper part.

Advantageously, the dispenser arm may be partly inserted into a lower part of the receptacle, the pivot axis of the dispenser arm being securely attached to this lower part of the receptacle. To allow the dispenser arm to pivot in the receptacle, the upper end of the dispenser arm may comprise a bevel formed on the side likely to come into contact with the receptacle. The bevel is made along a predetermined angle corresponding to the maximum pivot of the dispenser arm for example.

According to one embodiment of the invention, the upper end of the dispenser arm comprises means of preventing a second ball from entering the dispenser arm when the dispenser arm pivots to release a first ball already present in the dispenser arm. Preferably, the prevention means consist of a rim of the end of the dispenser arm.

The receptacle may comprise a bevel at its lower end to act as a stop for the pivoting of the dispenser arm. This stop may be sloping and contribute to setting accurately the pivoting angle of the arm at which the golf ball may descend.

Moreover, the internal diameter of the dispenser arm can be approximately equal to the internal diameter of the upper part of the receptacle.

According to a preferred embodiment of the invention, the dispenser comprises a protruding wedge, arranged on the inner surface of the lower part of the receptacle and cooperating with an opening made in the dispenser arm, such wedge being used to block the ball inserted in the dispenser arm, with the next ball resting on the first ball. The wedge is shaped in such a way as to release the golf ball present in the dispenser arm when the arm pivots. In particular, provision may be made for a wedge with a slope designed to release the ball present in the dispenser arm when the dispenser arm reaches a predetermined pivoting angle. This angle may be congruent with the slope of the bevel made on the receptacle.

In other words, the dispensing of the golf balls one by one is carried out by a simple mechanical binary divider, that is, when the golf ball container located above the flange is fed, with the dispenser arm in a vertical position, the golf balls drop into the flange, and then pass through the receptacle and one of them enters the dispenser arm, up to the wedge at which it is stopped. The player then pulls on the dispenser arm until it is positioned above the chosen location (for example after pivoting 20 degrees relative to the vertical axis) and the wedge becomes obliterated to allow the golf ball to drop to the planned positioning point (tee, mat or ground). As the dispenser arm is sloping in the dispensing position, the highest point of the upper edge of the dispenser arm will stop the next ball, so that only one ball can be present in the dispenser arm. When the dispenser arm returns to the vertical axis (simply by being released), the highest point will in turn move aside, which will allow another golf ball to drop as far as the wedge, and so on.

When the golf ball is deposited on a tee, the return of the dispenser arm will not carry the golf ball with it, as an opening, or cut-out, is made in the lower end of the dispenser arm.

According to a specific embodiment, the dispenser comprises magnets to hold the dispenser arm in either the rest position or the dispensing position. These magnets may be arranged in the receptacle.

Advantageously, the dispenser arm may comprise a brake allowing for the golf ball to be positioned accurately. The brake may consist of an "S" shaped bend made close to the lower end of the dispenser arm.

Moreover, the flange may comprise a tripod to hold the dispenser in an upper position. Preferably, the legs are telescopic. The tripod may comprise two front legs arranged on a vertical plane perpendicular to the direction of movement of the dispenser arm, such legs facing the user, and a third rear leg arranged on the opposite side to the two front legs relative to the flange. The two front legs may be such that the first leg is approximately vertical, and the second leg is sloping to balance the tripod. The third rear leg may also be designed so that it comprises a hook that can take a weight in order to increase the balance of the tripod. The putter may be used as this counterweight, as the putter is the only club that is never used on the practice range, but is always in a golf bag. Instead of the club, or in addition to it, a bottle of water can be used as a counterweight.

According to the invention, the three legs may be removable and have a diameter such that they can be housed inside the dispenser arm for transport.

To facilitate the positioning of the dispenser on the practice range and to determine the distance between the tee and the dispenser easily, the receptacle may be height-adjustable relative to the flange. For example, the adjustment height may be 40 mm, which generally corresponds to the height of the tee. The dispenser can therefore be adapted easily depending on the size of the tee (small for irons, big for drivers).

According to one embodiment of the invention, the upper container consists of a vertical barrel arranged above the flange. The axis of rotation of the barrel is offset relative to the axis of the upper opening of the receptacle so that the balls stored in the peripheral cavities of the barrel can fall vertically into the receptacle.

Moreover, the barrel may be topped with a disc comprising peripheral openings facing the cavities in the said barrel in order to guide the balls into the cavities. The disc also comprises a central protrusion to guide the balls towards these peripheral openings. The dispenser also comprises a removable funnel, flared towards the top, that engages with the edge of the disc. The balls are tipped into the funnel, which guides them into the cavities in the barrel.

Advantageously, the inside of the dispenser arm may comprise several non-concentric rings to slow down the drop of the golf ball. These rings are arranged so that the distance between two consecutive rings decreases towards the lower end of the dispenser arm.

Other advantages and characteristics of the invention will become apparent on examining the detailed description of an embodiment that is in no way limitative, and the appended drawings, in which.

Figure 1:
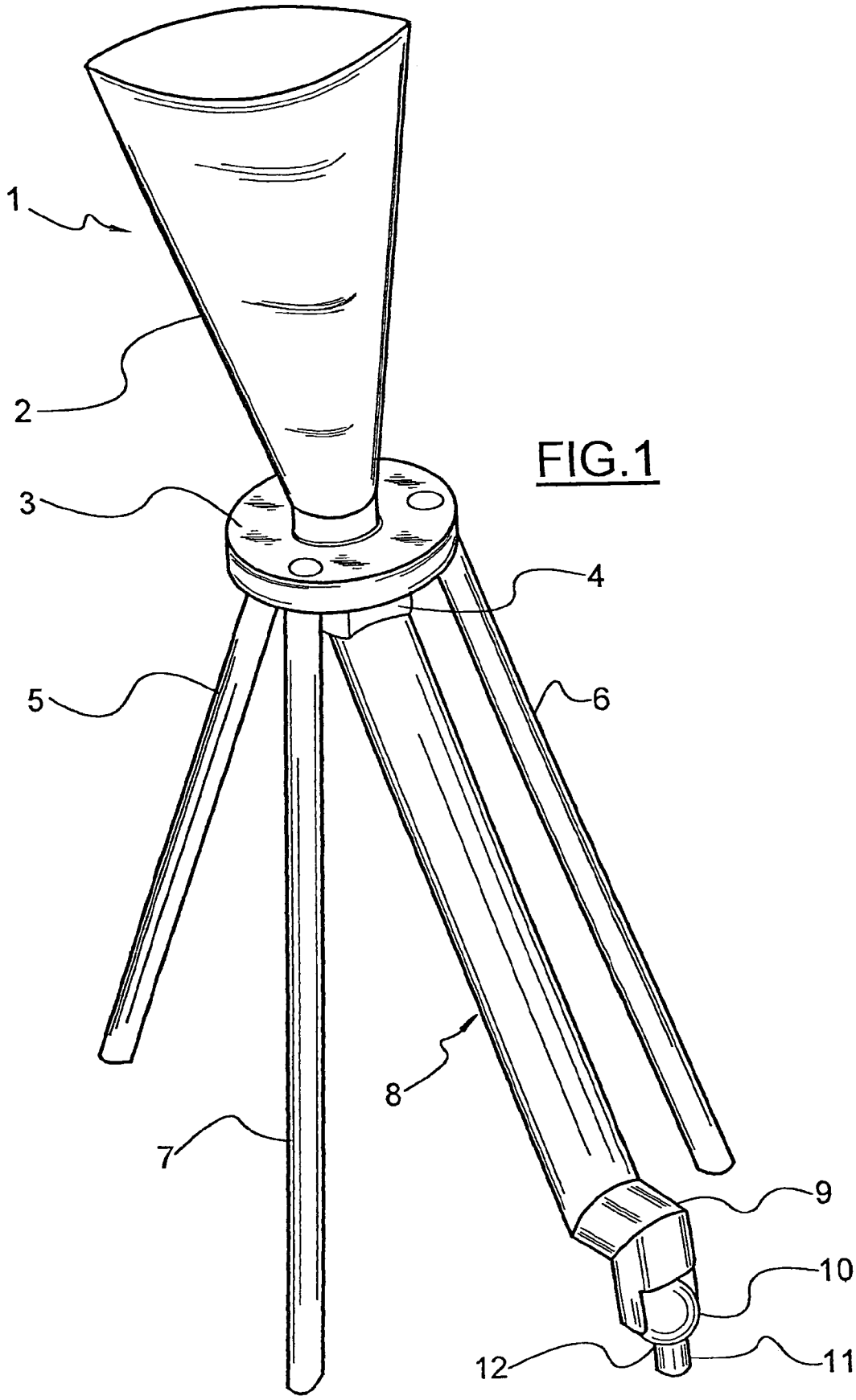
FIG. 1 is a general view of the golf ball dispenser according to the invention.

FIG. 1 shows the golf ball dispenser 1 according to the invention. This dispenser comprises a container 2 into which the golf balls are inserted, the container 2 being positioned on a flange 3 to which a tripod made up of the front legs 6, 7 and one rear leg 5 is fixed. The flange 3 is linked to a receptacle 4 arranged through the flange 3 so that the container 2 is directly engaged with the upper opening of the receptacle 4. The lower part of the receptacle 4, under the flange 3, is pivotably engaged with a dispenser arm 8. This arm is used to carry a golf ball 10 coming from the container 2 via the receptacle 4, onto a tee 11 arranged on the ground. The golf ball container, placed above the flange, has a capacity at least equal to the quantity of a bucket of golf balls. This container is made from plastic sheeting that is sufficiently flexible for it to be wrapped around the upper part of the receptacle extending above the flange, in order to obtain minimum overall dimensions in order to make the assembly easy to transport. For the same reason of dimensions, the three legs (which are telescopic so that they can be adapted to all dimensional situations) supporting the ball dispenser can be housed in the dispenser arm, for example three 19 mm diameter legs within a 44 mm diameter.

In a rest position, the dispenser arm 8 is placed vertically under the receptacle 4. The receptacle comprises means of placing a single golf ball in the upper part of the dispenser arm 8 inserted in the receptacle 4.

In a dispensing position, the dispenser arm 8 has pivoted by a predetermined angle in order to place its lower end above the tee 11, which means that the golf ball 10 can be deposited on the tee. The ball is positioned accurately as the dispenser arm 8 comprises a brake 9 in the form of a sufficiently sharp bend to brake the golf ball dropping from the upper end by gravity. An opening 12 is cut out of the brake 9, extending to the lower end of the dispenser arm 8 so that the dispenser arm 8 does not take the golf ball 10 with it when it returns to its rest position.

To pivot the dispenser arm 8, the user, that is, the golfer, can use a golf club by hooking the brake 9 for example. This enables to the golfer to not bend down to take a ball, either from a bucket of practice balls, or to position it in a specific place on the ground or on a tee. The player can then keep his previous stance (positioning of the legs relative to the tee) without changing his last position.

Figure 2:
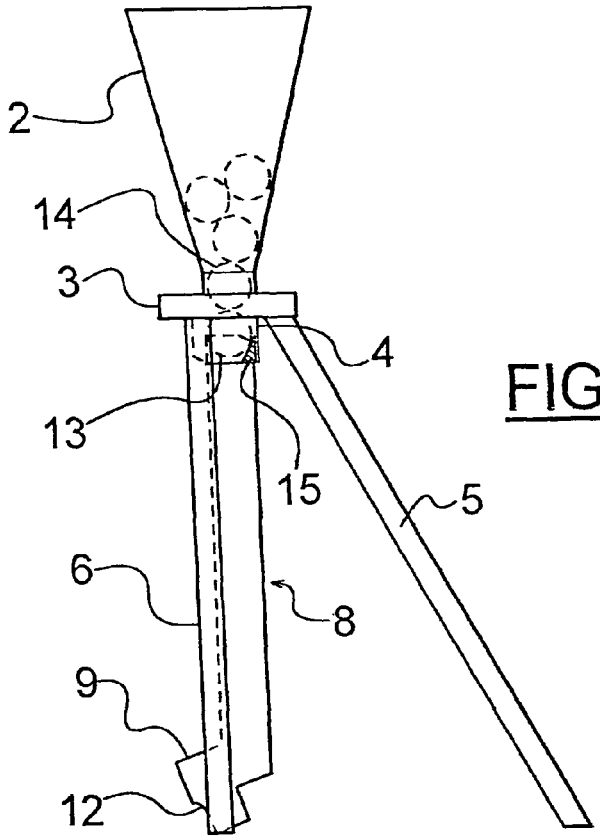
FIG. 2 is a side view of the golf ball dispenser according to the invention in a rest position.

FIG. 2 shows a schematic side view of the golf ball dispenser according to the invention. Most of the components in FIG. 1 are shown here with the same references. In particular, the front leg 6 and the rear leg 5 are shown again. The dispenser arm 8 is in a rest position. The container 2 contains a set of golf balls, including a first ball 13 and a second ball 14. The receptacle 4 is in tubular form so that the golf balls can enter one by one.

Figure 3:
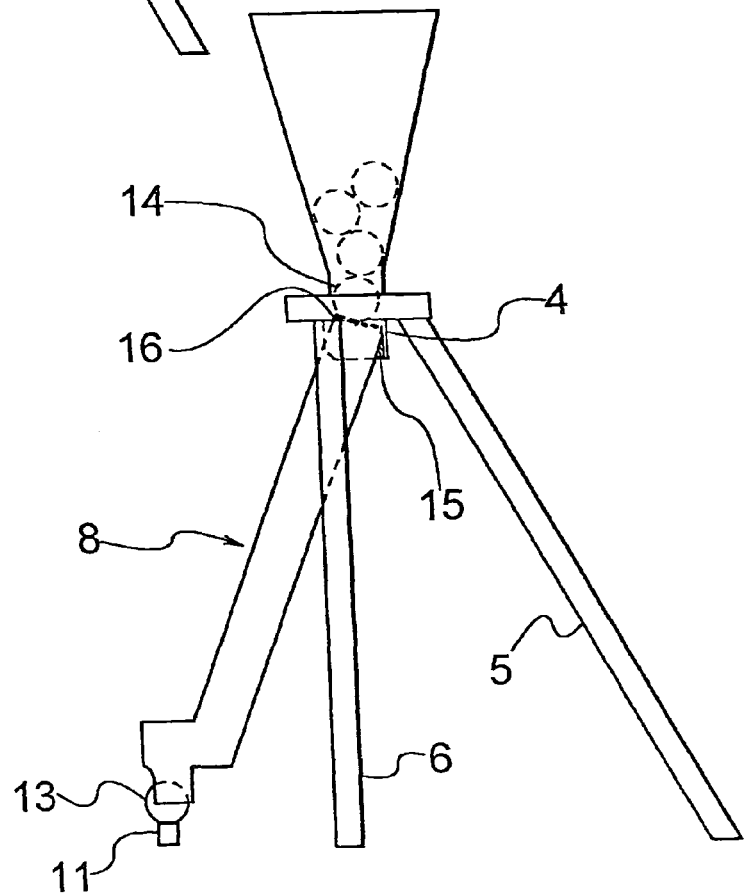
FIG. 3 is a side view of the golf ball dispenser according to the invention in a dispensing position.
Figure 4:
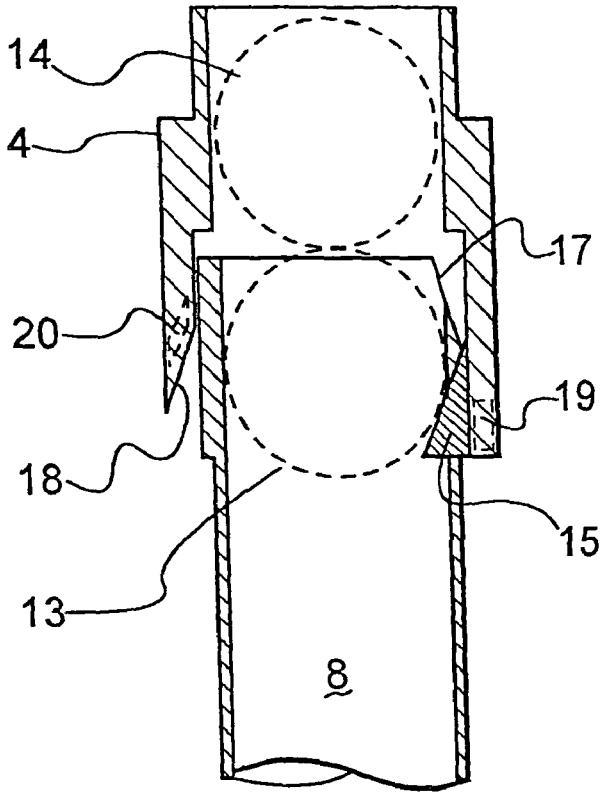
FIG. 4 is a detailed view of the central part of the dispenser in a rest position.
Figure 5:
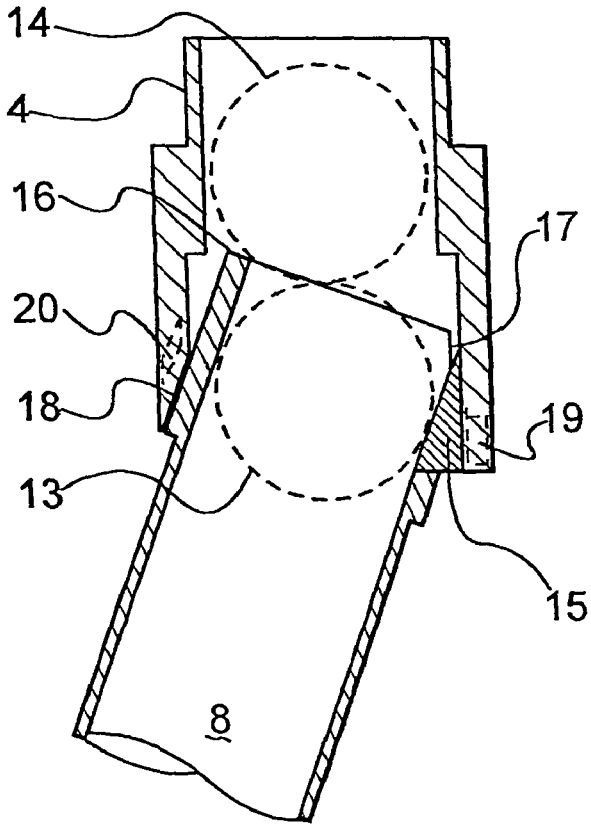
FIG. 5 is a detailed side view of the dispenser in a dispensing position.

In a rest position, it can be seen that the first ball 13, guided by the receptacle 4, enters the upper part of the dispenser arm 8, such upper part being inserted into the receptacle 4. The ball 13 does not slide along the dispenser arm 8 because it is held back by the wedge 15. This wedge 15, which is triangular according to this view, is securely attached to the receptacle 4. Advantageously, the dispenser arm 8 comprises, opposite the wedge 15, an opening allowing the wedge 15 to be partly inside dispenser arm 8. The first golf ball 13 therefore comes to rest on a sloping plane of the wedge 15 and on an opposite inner edge of the dispenser arm 8. The second golf ball 14, guided into the receptacle 4, comes to rest on the first golf ball 13. When the user pivots the dispenser arm 8 from its rest position to a dispensing position in accordance with FIG. 3, at a predetermined angle, the wedge 15 moves aside and allows the golf ball 13 to slide by gravity to the brake 9 and onto the tee 11. The upper end of the dispenser arm 8 is shaped so that the edge 16, which is diametrically opposite the wedge 15, pivots in such a way as to block the descent by gravity of the second golf ball 14. Thus, the dispenser arm 8 can only carry a single golf ball at a time. FIGS. 4 and 5 show the mechanism operated within the receptacle 4 in more detail.

FIG. 4 shows the dispenser arm 8 in a rest position, with the golf ball 13 partly inserted in the upper part of the dispenser arm 8. The second golf ball 14 is resting on the first golf ball 13 but outside the dispenser arm 8 and inside the receptacle 4. The bevel 18 in the receptacle 4 will act as a stop to specify the degree of slope of the dispenser arm 8 in its dispensing position in accordance with FIG. 5. The bevel 17 made in one edge of the upper end of the dispenser arm 8, on the side of the wedge 15, allows for the dispenser arm 8 to be pivoted inside the lower part of the receptacle 4.

The magnet 19 placed at the lower end of the receptacle 4 allows for the dispenser arm 8 to be held in the rest position and for any rebound effect to be prevented when the dispenser arm 8 returns from a dispensing position. This magnet 19 may extend on either side of the lateral side of the wedge 15 so that it influences the dispenser arm 8. The arm may comprise metal components designed to cooperate magnetically with the magnet 19.

Similarly, the magnet 20 arranged on the opposite side to the magnet 19 allows for the dispenser arm 8 to be held in the dispensing position and for the arm to be prevented from returning prematurely.

In FIG. 5, in the dispensing position, the wedge 15 moves aside in order to allow the ball 13 to slide inside the dispenser arm 8. The edge 16 holds the second golf ball outside the dispenser arm 8. This second golf ball 14 will only be able to enter the dispenser arm 8 when the latter has returned to its rest position.

Figure 6:
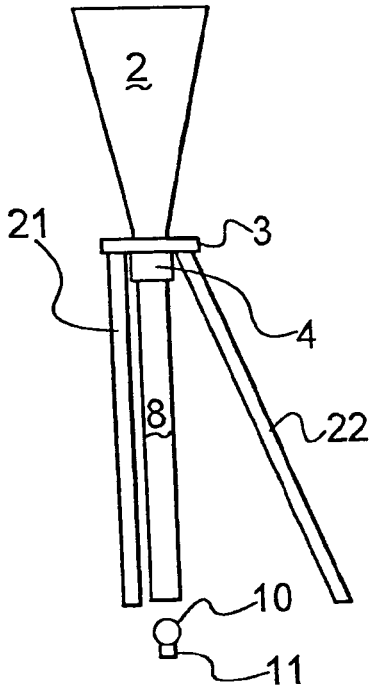
FIG. 6 is a front view of a specific embodiment of the golf ball dispenser according to the invention.
Figure 15:
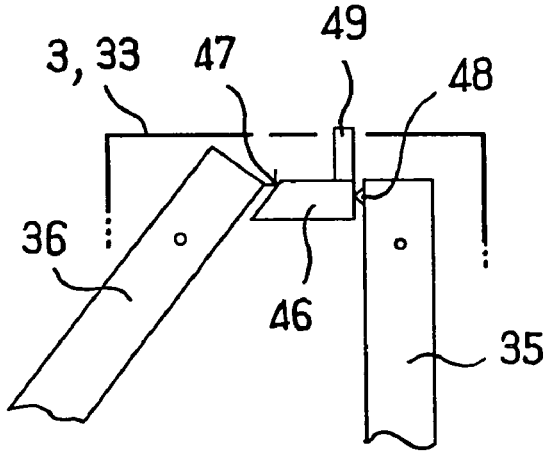
FIG. 15 is a schematic sectional view showing a reversible block in the flange.

FIG. 6 shows an embodiment of the golf ball dispenser according to the invention. In this embodiment, the two front legs are such that the first leg 21 is arranged practically vertically, that is, perpendicular to the flange 3, and the second leg 22 is sloping considerably outwards relative to the first leg 21. The third rear leg always remains sloping to the rear. The golf ball 10 is placed on the tee 11 between the golfer and the golf ball dispenser. This embodiment is ideal when the golfer is practicing sending the ball in a lateral movement from the leg 22 towards the leg 21. The player thus has a large angle of play as the leg 21 is not in the line of fire. This embodiment also reduces the risk that in the event of a shank, that is, an incorrectly hit golf ball, the golf ball will touch the leg of the dispenser. This embodiment can also be made so that the leg 22 is vertical and the leg 21 is significantly sloping, depending on whether the player is right- or left-handed. To do this, in accordance with FIG. 15, the flange 3 (or 33 as will be seen below) comprises a reversible block to position the two front legs in a first position in which the left-hand leg is sloping and in a second position in which the right-hand leg is sloping. The cross-section of the block 46 is a quadrilateral the left-hand side 47 of which has an angle designed to wedge the sloping leg 36, and the right-hand side 48 of which is vertical to keep the leg 35 straight. To reverse the positioning, that is, leg 36 straight and leg 35 sloping, the block 46 is pivoted by 180° so that its side 47 is along the leg 35. A rod 49 securely attached to the block 46 can be inserted into openings made in the upper surface of the flange, with these openings acting as positioning markers.

Figure 7:
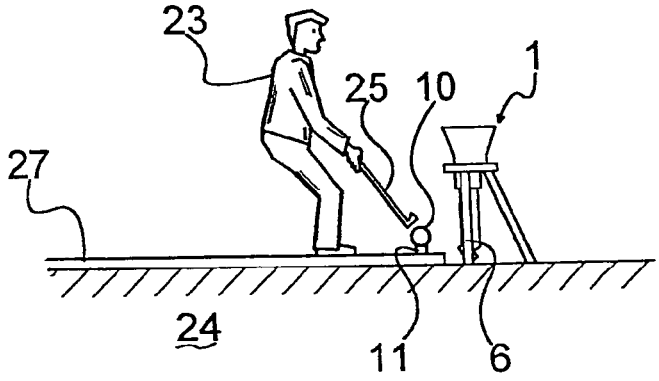
FIG. 7 is an embodiment of the dispenser according to the invention for a standard practice range.
Figure 8:
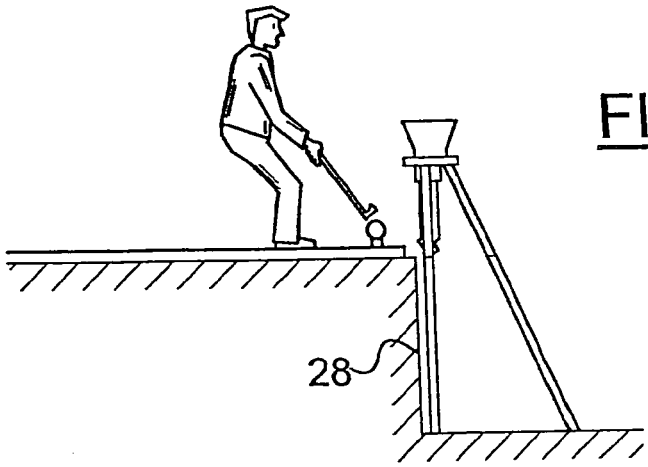
FIG. 8 is another embodiment of the dispenser according to the invention for a practice range with a significant difference in level.

FIGS. 7 and 8 show a golfer 23 preparing to hit the golf ball 10 using a golf club 25. The player is positioned on a practice mat 27, the latter being placed on the ground 24. The ball dispenser is placed in front of the golfer 23. The dispenser is positioned in such a way that the dispensing position of the dispenser arm 8 allows for the golf ball to be placed above the tee 11. In a standard arrangement, the mat 27 is placed on flat ground 24. In this case, the dispenser 1 can be placed on the mat or on the ground 24. However, in non-standard configurations, that is, when the ground 24 has a significant difference in level in accordance with FIG. 8, the current systems cannot be used. The dispenser 1 according to the invention can however be used easily as it has telescopic legs. These telescopic legs can be used equally in extreme cases of significant difference in level and in standard conditions of use. As an example, each leg can be extended by around 200 mm to adapt to different types of ground. The receptacle can then be fixed.

Generally, the two front legs 5 and 6 can be sloping towards the golfer or remain vertical. When these legs are arranged vertically, the golfer has more space.

Of course, the invention is not limited to the examples that have just been described and a number of adjustments can be made to these examples without leaving the scope of the invention. In particular, a golf club could be placed on a hook made on the rear leg 5, in order to make the rear leg 5 heavier and thus balance the dispenser if necessary. A bottle can also be arranged as seen in FIG. 10.

Figure 9:
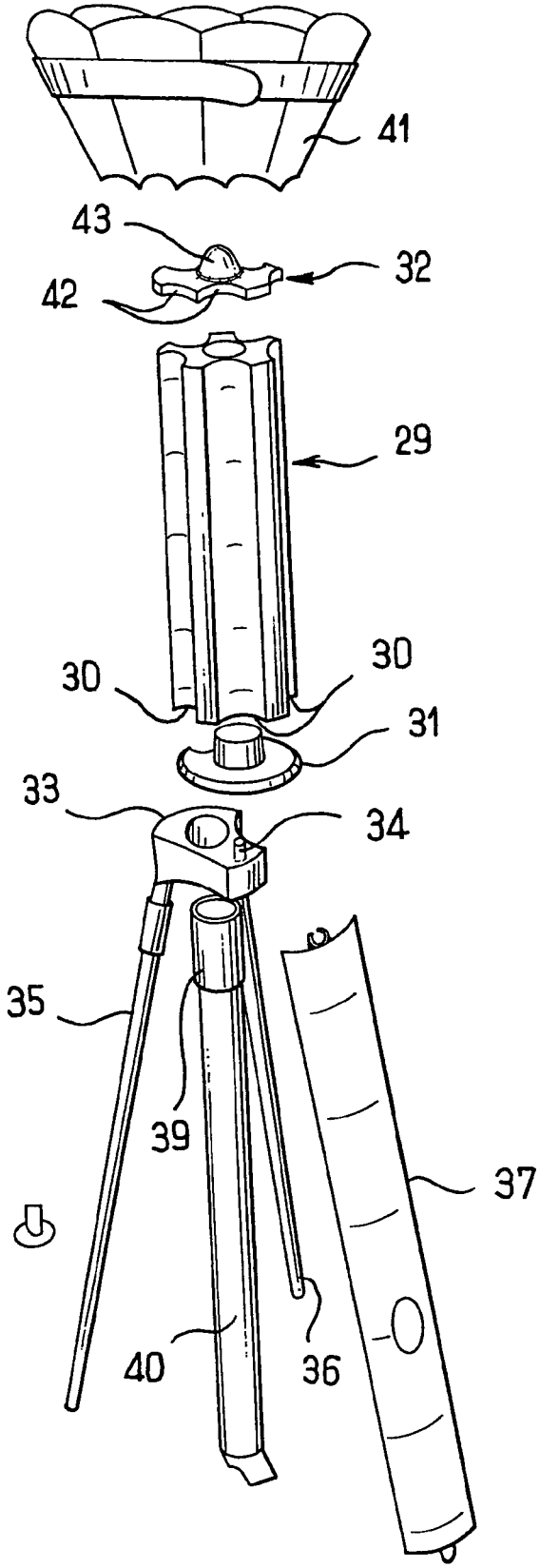
FIG. 9 is an exploded view of a device according to the invention with a barrel as a container.
Figure 10:
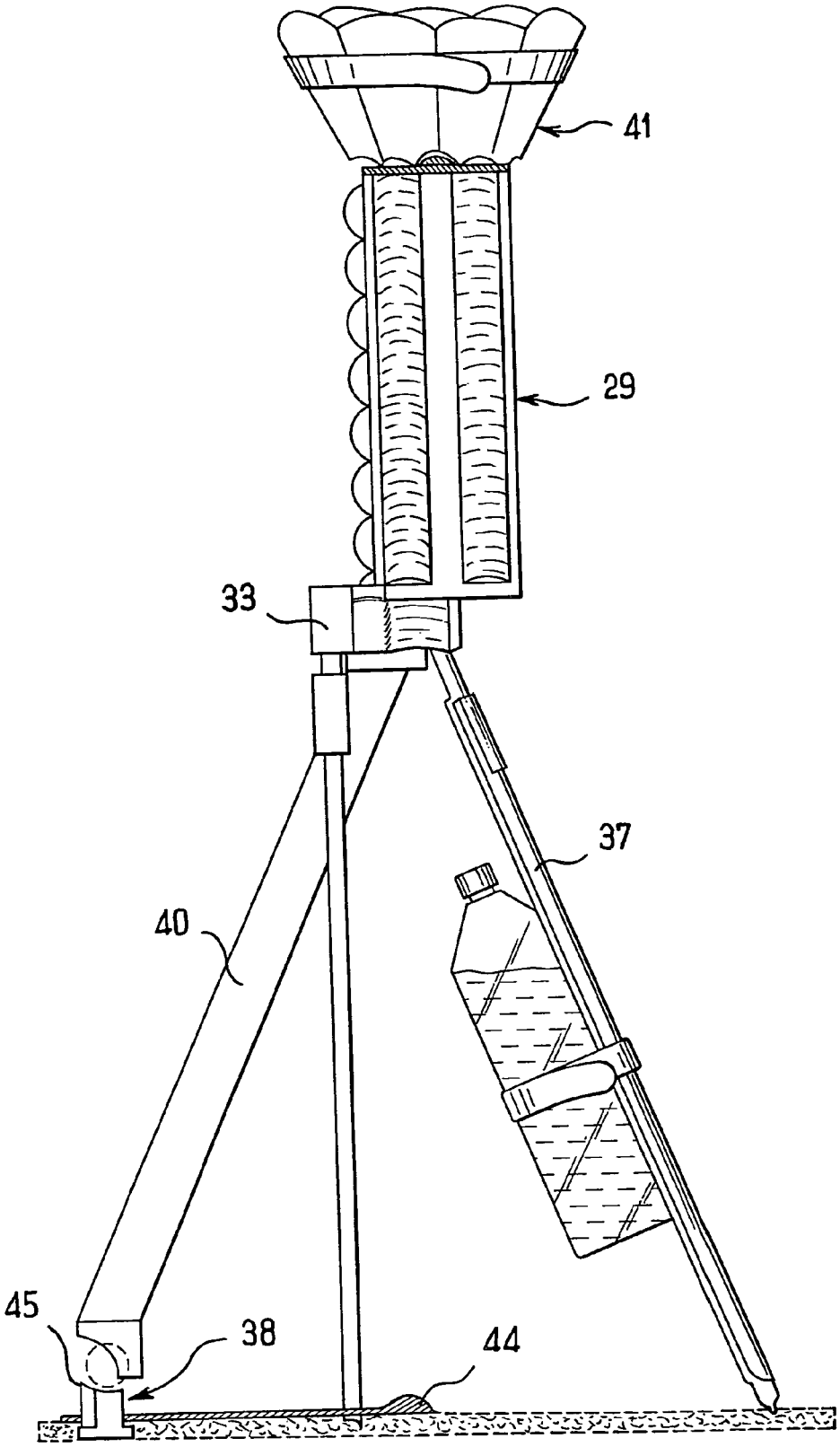
FIG. 10 is a view of the dispenser with the barrel in a dispensing position.

The container 2 as described in the previous figures could also be replaced by a barrel 29 as seen in FIGS. 9 and 10. The advantage of this is that the possibility of blockages of balls that might occur at the neck of the container 2 is avoided.

In FIGS. 9 and 10, the barrel 29 is topped with an integral disc 32. A funnel 41 is fixed to the disc 32 so that when the funnel 41 is filled with balls, they are guided into the cavities 30 by means of the openings 42 and the protrusion 43 on the disc 32. The lower end of the barrel can pivot around a second disc 31 engaging eccentrically with the flange 33 by means of a axis 34.

For a given position of the barrel 29, a cavity in the latter is concentric with an opening made in the second disc 31 and with the opening made in the flange 33. The balls then slide directly vertically from the barrel to the dispenser arm 40 via the receptacle 39. Here, the receptacle 39 is shown very schematically and may advantageously correspond to the embodiment in FIGS. 4 and 5.

For transport, the funnel 41 and barrel 29 assembly is dismantled. The two components can be securely attached to each other or removable from each other.

Figure 11:
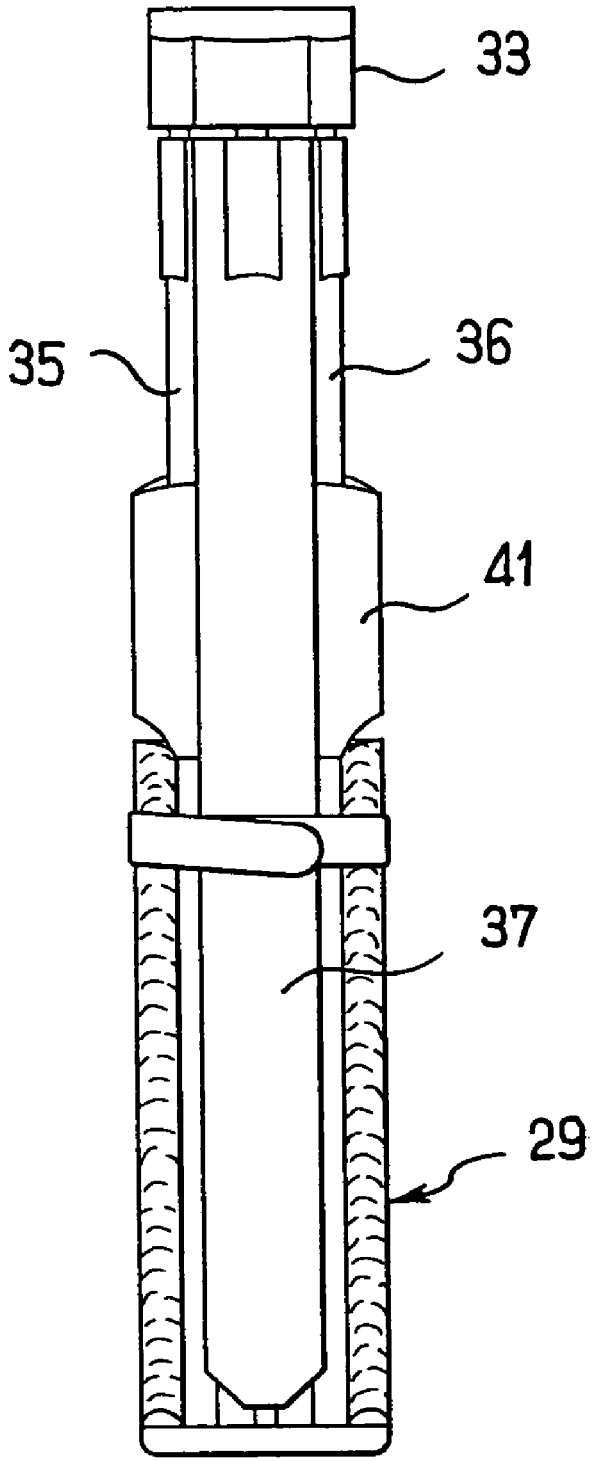
FIG. 11 is a view of the dispenser in FIGS. 9 and 10 in its transport position.

The support 33, 40, 35, 36, 37 is then nested in the assembly 41, 29 through the top of the latter. The barrel 29 comprises a central tunnel in which the dispenser arm 40 is engaged. The legs 35 and 36 are wedged in two cavities 30 in the barrel. The third leg 37 is held against the barrel. FIG. 11 shows the dispenser in FIGS. 9 and 10 in its transport position.

FIG. 10 shows a gauge 44 allowing for the tee 38 to be placed at an appropriate distance. Advantageously, the tee 38 comprises a return protuberance 45 to prevent the golf ball from rolling off when it drops approximately vertically from the dispenser arm of the dispenser. This protuberance extends upwards from one side of the tee. When the golf ball is in a rest position on the receiving surface, the protuberance 45 and the ball are separate from each other, for example by 2 mm. The protuberance and the ball are thus not in contact, and the golfer's club can then hit the ball without the protuberance hindering and therefore modifying the trajectory of the ball.

Figure 12:
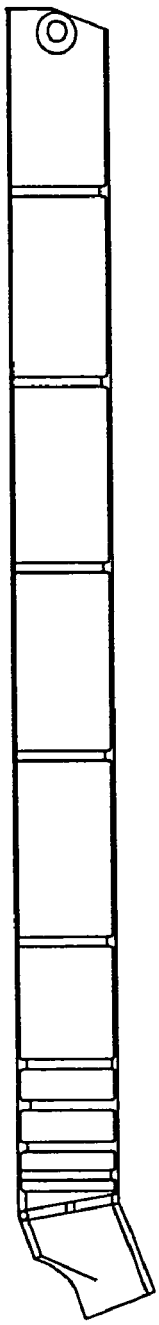
FIG. 12 is a diagram showing the inside of a dispenser arm, in its bent position, fitted with a brake in the form of non-concentric rings.
Figure 13:
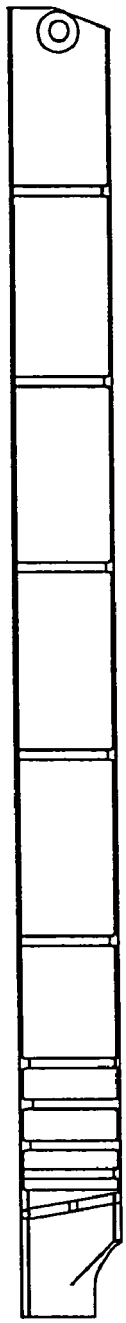
FIG. 13 is a diagram showing the inside of a dispenser arm, in its straight transport position, fitted with a brake in the form of non-concentric rings.
Figure 14:
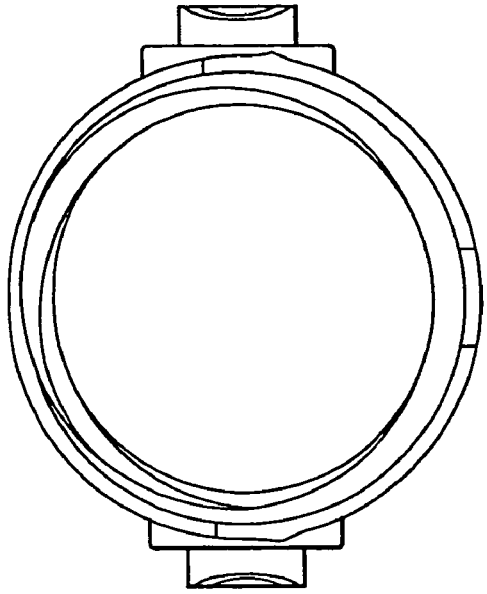
FIG. 14 is a schematic top view of the dispenser arm in FIG. 13.

FIGS. 12 and 13 show the inside of the dispenser arm 40 made up of a plurality of non-concentric rings. FIG. 12 shows a bent dispenser arm. This bend can pivot by means of a rotating joint so that it is straight, that is, aligned with the dispenser arm as a whole as in FIG. 13. The bent position has an angle such that the bend is vertical and the ball can thus drop vertically when the arm is in its dispensing position. This angle can be 160° when the arm is at 20° relative to the vertical in its dispensing position. FIG. 14 is a top view showing the arrangement of the various rings in the arm. The closer to the lower end, the closer the rings are to each other. This arrangement allows for the drop of the golf ball to be slowed down. The lower end can be bent or otherwise. The internal diameter of the rings is slightly greater than the diameter of the golf balls.

The invention claimed is:

1. A golf ball dispenser comprising an upper container to contain golf balls and a flange to receive the balls coming from the container and supply a dispenser arm with balls one by one, such dispenser arm being arranged substantially vertically in a rest position and comprising means, arranged in the upper part close to the flange to receive balls one by one from the container, a lower end intended to dispense balls, and a pivoting means arranged in the upper end of the dispenser arm close to the flange for pivoting around a horizontal axis during a golf ball dispensing from said rest position to a dispensing position, said dispensing arm returning to said rest position from said dispensing position without a spring and without a counterweight.

2. The dispenser according to claim 1, wherein the upper end of the dispenser arm comprises means of preventing a second ball from entering the dispenser arm when the dispenser arm pivots to release a first ball already present in the dispenser arm.

3. The dispenser according to claim 2, wherein the prevention means consist of a rim of the end of the dispenser arm.

4. The dispenser according to claim 1, wherein the dispenser arm comprises a brake allowing for the golf ball to be deposited accurately.

5. The dispenser according to claim 4, wherein the brake is an "S" shaped bend made close to the lower end of the dispenser arm.

6. The dispenser according to claim 1, wherein the inside of the dispenser arm comprises several non-concentric rings to slow down the drop of the golf ball.

7. The dispenser according to claim 6, wherein the rings are arranged so that the distance between two consecutive rings decreases closer to the lower end of the dispenser arm.

* * * * *